US008227998B2

(12) United States Patent
Liu et al.

(10) Patent No.: US 8,227,998 B2
(45) Date of Patent: Jul. 24, 2012

(54) CONTROLLER FOR CONTROLLING DIMMING OF A LIGHT SOURCE

(75) Inventors: Jian Liu, Chengdu (CN); Luyang Luo, Chengdu (CN); Lianping Chen, Chengdu (CN); Ching-Chuan Kuo, Taipei (TW)

(73) Assignee: O2Micro, Inc., Santa Clara, CA (US)

( * ) Notice: Subject to any disclaimer, the term of this patent is extended or adjusted under 35 U.S.C. 154(b) by 8 days.

(21) Appl. No.: 12/892,547

(22) Filed: Sep. 28, 2010

(65) Prior Publication Data

US 2011/0074308 A1 Mar. 31, 2011

(30) Foreign Application Priority Data

Sep. 7, 2010 (CN) ..... 2010 1 0276807

(51) Int. Cl.
*H05B 41/16* (2006.01)

(52) U.S. Cl. ..... 315/247; 315/291; 315/224; 315/307; 315/185 S

(58) Field of Classification Search ..... 315/247, 315/185 S, 224, 225, 291, 297, 307–326
See application file for complete search history.

(56) References Cited

U.S. PATENT DOCUMENTS

| | | | | |
|---|---|---|---|---|
| 7,049,752 | B2 | 5/2006 | Tani et al. | |
| 7,317,403 | B2 | 1/2008 | Grootes et al. | |
| 2008/0136350 | A1 * | 6/2008 | Tripathi et al. | 315/294 |
| 2008/0180039 | A1 | 7/2008 | Masuko | |
| 2009/0243994 | A1 | 10/2009 | Hatano et al. | |

FOREIGN PATENT DOCUMENTS

| | | | |
|---|---|---|---|
| CN | 1558704 | A | 12/2004 |
| CN | 101232761 | A | 7/2008 |
| CN | 101253813 | A | 8/2008 |
| CN | 101433130 | A | 5/2009 |
| CN | 201523469 | U | 7/2010 |

* cited by examiner

*Primary Examiner* — Tuyet Thi Vo

(57) ABSTRACT

A controller for controlling dimming of a light source includes a detector, a dimming signal generator coupled to the detector, and a pulse generator coupled to the dimming signal generator. The detector can detect a startup phase of a burst dimming cycle of the light source and can generate a triggering signal when the startup phase ends. The burst dimming cycle includes an ON period and an OFF period. The dimming signal generator can trigger the ON period of the burst dimming cycle for a predetermined duration in response to the triggering signal. The pulse generator operable for generating a pulse signal to control a current through the light source can be enabled during the ON period and disabled during the OFF period.

10 Claims, 8 Drawing Sheets

CONTROLLER FOR CONTROLLING DIMMING OF A LIGHT SOURCE

RELATED APPLICATION

This application claims priority to Chinese Patent Application No. 201010276807.X, titled Controller for Controlling Dimming of A Light Source, filed on Sep. 7, 2010, which is hereby incorporated by reference in its entirety.

BACKGROUND

Burst dimming cycles can be used to control brightness of a light source, e.g., a light emitting diode (LED). A burst dimming cycle includes an ON period and an OFF period. A plurality of current pulses pass through the light source during the ON period and no current flows through the light source during the OFF period. Thus, the brightness of the light source can be controlled by adjusting duty cycle of the burst dimming cycles.

FIG. 1(*a*) shows the waveform of a burst dimming signal 110 for controlling the brightness of a light source. The burst dimming signal 110 is switched between an ON period and an OFF period alternately. The durations of the ON period and the off period can be predetermined. FIG. 1(*b*) shows an average current flowing through the light source controlled by the burst dimming signal 110 under an ideal circumstance. Thus, the average current of the light source is substantially constant during an ON period of the burst dimming signal 110 and is zero during an OFF period of the burst dimming signal 110. However, in practical applications, a capacitor may be coupled to the light source in parallel. During the OFF period, the capacitor is discharged to the light source and thus a voltage of the capacitor drops to zero quickly. During the ON period, the voltage of the capacitor gradually rises and no current flows through the light source until the voltage of the capacitor rises to a certain level. Thus, there is a startup phase of the current of the light source. FIG. 1(*c*) shows an average current flowing through the light source controlled by the burst dimming signal 110 in a practical application. As shown in FIG. 1(*c*), the average current of the light source gradually increases from zero. During the startup phase, almost no current flows through the light source. The duration of the startup phase varies in different practical applications. Therefore, the time period when the average current of the light source is substantially constant during an ON period of the burst dimming signal is uncertain and varies in different applications. As a result, the brightness of the light source is not controlled very accurately and the brightness of the light source may vary in different applications.

FIG. 2 shows a burst dimming driving circuit 200 in the prior art. A converter formed by an inductor 202, a diode 204, and a switch 206 converts an input voltage $V_{IN}$ to an output voltage $V_{OUT}$ to power a light source, e.g., an LED string 230, and produce a current through the LED string 230. The driving circuit 200 further includes a switch 220. A capacitor 240 is coupled to the LED string 230 and the switch 220 in parallel. The switch 220 is controlled by a burst dimming signal at a pin PWMOUT of a controller 210. A pulse-width modulation (PWM) signal is received by a pin PWM of the controller 210. The burst dimming signal having an ON period and an OFF period is generated at the pin PWMOUT according to the PWM signal. During the OFF period, the switch 220 is turned off to disconnect the LED string 230 from the capacitor 240. Thus, the voltage of the capacitor 240 drops in a relatively slow speed. When the ON period starts, the switch 220 is turned on and the voltage of the capacitor 240 is still beyond a certain level. Thus, the current through the LED string 230 can be established faster compared to the prior art in FIG. 1. Therefore, the accuracy of the ON period is improved, thereby enhancing the accuracy of the dimming control. However, the cost of the burst dimming driving circuit 200 is relatively high because of the extra pins PWM and PWMOUT and the switch 220.

SUMMARY

In one embodiment, a controller for controlling dimming of a light source includes a detector, a dimming signal generator coupled to the detector, and a pulse generator coupled to the dimming signal generator. The detector can detect a startup phase of a burst dimming cycle of the light source and can generate a triggering signal when the startup phase ends. The burst dimming cycle includes an ON period and an OFF period. The dimming signal generator can trigger the ON period of the burst dimming cycle for a predetermined duration in response to the triggering signal. The pulse generator operable for generating a pulse signal to control a current through the light source can be enabled during the ON period and disabled during the OFF period.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

FIG. 1(*b*) is a diagram showing an average current flowing through the light source controlled by the burst dimming signal under an ideal circumstance in the prior art. FIG. 1(*c*) is a diagram showing an average current flowing through the light source controlled by the burst dimming signal in a practical application in the prior art.

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Embodiments in accordance with the present invention provides a controller for controlling dimming of a light source according to burst dimming cycles. The controller monitors a current through the light source to detect a startup phase of a burst dimming cycle. Once the startup phase of the burst dimming cycle ends, the controller triggers an ON period of the burst dimming cycle for a predetermined duration. Advantageously, the accuracy of the ON period of the burst dimming cycle is improved, thereby improving the accuracy of the dimming control of the light source.

Figure 3:
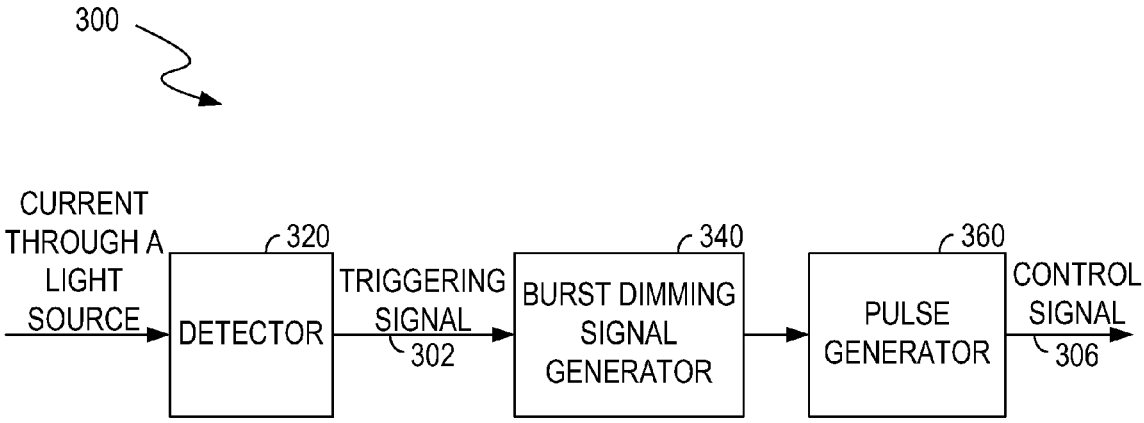
FIG. 3 is a block diagram showing a controller for controlling dimming of a light source according to one embodiment of the present invention.

FIG. 3 shows a controller 300 according to one embodiment of the present invention. In the example of FIG. 3, the controller 300 includes a detector 320, a burst dimming signal generator 340, and a pulse generator 360. The detector 320 monitors a current through a light source to detect a startup phase of a burst dimming cycle and generate a triggering signal 302 when the startup phase ends. The startup phase refers to a duration when the current flowing through the light source rises from an initial value, e.g., zero, to a predetermined current when the light source is initially powered on, in one embodiment. The light source can include, but is not limited to, a light emitting diode (LED).

The burst dimming signal generator 340 is coupled to the detector 320 and can trigger the ON period of the burst dimming cycle for a predetermined duration in response to the triggering signal 302. The pulse generator 360 is coupled to the burst dimming signal generator 340 and is operable for generating a control signal 306, e.g., a pulse signal, to control dimming of the light source. More specifically, the pulse generator 360 is enabled during the ON period of the burst dimming cycle and is disabled during the OFF period of the burst dimming cycle. By way of example, the control signal 306 generated by the controller 300 includes a plurality of pulses during the ON period and is logic low during the OFF period.

Figure 4:
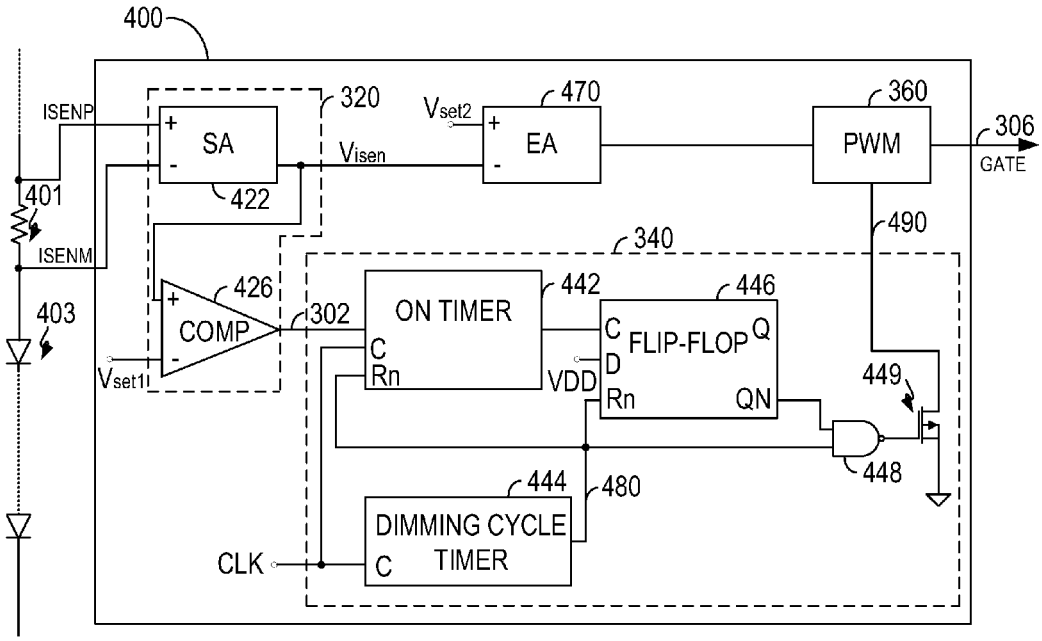
FIG. 4 is a detailed block diagram showing a controller for controlling dimming of a light source according to one embodiment of the present invention.

FIG. 4 shows a detailed block diagram of a controller 400 coupled to a light source, e.g., an LED string 403, according to one embodiment of the present invention. Elements labeled the same as in FIG. 3 have similar functions. In the example of FIG. 4, the controller 400 includes the detector 320, the burst dimming signal generator 340, and the pulse generator 360. The controller 400 can be integrated in an integrated circuit (IC).

The detector 320 is operable for generating a triggering signal 302 when a startup phase of the current through the LED string 403 ends, e.g., when the current flowing through the LED string 403 increases to a predetermined value. In the example of FIG. 4, the detector 320 includes a sense amplifier 422 and a comparator 426. A resistor 401 is coupled to the LED string 403 in series. The sense amplifier 422 receives voltages at terminals of the resistor 401 via pin ISENP and pin ISENM and outputs a monitoring signal $V_{isen}$ that is proportional to the voltage drop across the resistor 401, in one embodiment. Thus, the monitoring signal $V_{isen}$ indicates the current flowing through the LED string 403. The comparator 426 compares the monitoring signal $V_{isen}$ to a reference signal $V_{set1}$ and generates the triggering signal 302 when a difference between the monitoring signal $V_{isen}$ and the reference signal $V_{set1}$ exceeds a threshold. In other words, the detector 320 generates the triggering signal 302 when the current flowing through the LED string 403 increases to a predetermined value.

The burst dimming signal generator 340 is operable for generating a burst dimming signal 490 to control the pulse generator 360. In the example of FIG. 4, the burst dimming signal generator 340 includes an ON timer 442, a dimming cycle timer 444, a flip-flop 446, an NAND gate 448, and a switch 449. In one embodiment, the timers 442 and 444 share a clock signal CLK. The ON timer 442 is triggered by the triggering signal 302 generated by the comparator 426. The flip-flop 446 receives an output of the ON timer 442 at terminal C and a power supply voltage VDD at terminal D. The timer 444 provides a dimming cycle control signal 480 to a reset terminal Rn of the timer 442 and a reset terminal Rn of the flip-flop 446. The NAND gate 448 receives the dimming cycle control signal 480 and an output signal at an output terminal QN of the flip-flop 446.

In the example of FIG. 4, the switch 449 is coupled between the pulse generator 360 and ground and is controlled by an output of the NAND gate 448. In one embodiment, when the switch 449 is on, the burst dimming signal 490 is pulled down to logic low, and thus the pulse generator 360 is disabled. When the switch 449 is off, the burst dimming signal 490 is pulled up to logic high, and thus the pulse generator 360 is enabled. The switch 449 is turned on and off alternately. The pulse generator 360 generates the control signal 306 via pin GATE.

Figure 5:
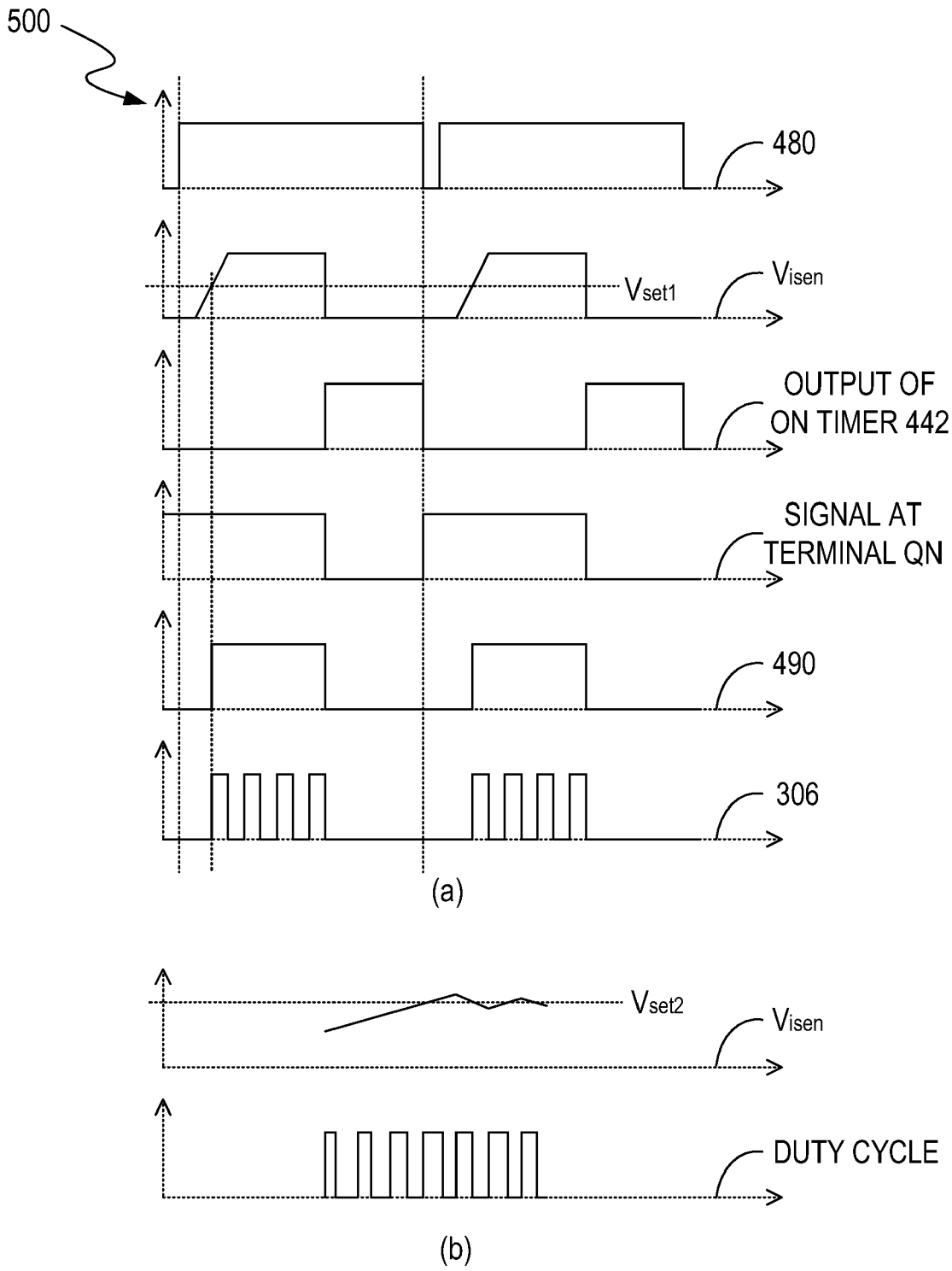
FIG. 5 is a diagram showing waveforms associated with a controller for controlling dimming of a light source according to one embodiment of the present invention.

FIG. 5(*a*) shows examples for the waveforms of the dimming cycle control signal 480, the monitoring signal $V_{isen}$, the output of the ON timer 442, the signal at the terminal QN of the flip-flop 446, the burst dimming signal 490, and the control signal 306. FIG. 5(*a*) is described in combination with FIG. 4.

The dimming cycle timer 444 generates the dimming cycle control signal 480 having a first state (e.g., logic high) for a predetermined duration, and a second state (e.g., logic low) for a predetermined duration alternately. When the dimming cycle control signal 480 is in the second state, the ON timer 442 and the flip-flop 446 are reset and the signal at the output terminal QN of the flip-flop 446 is logic high. Thus, the inputs to the NAND gate 448 are logic high and low respectively such that the output signal of the NAND gate 448 is logic high. Therefore, the switch 449 is turned on and the burst dimming signal 490 is logic low. Accordingly, the pulse generator 360 is disabled when the dimming cycle control signal 480 is in the second state.

When the dimming cycle control signal 480 is switched from the second state to the first state, a burst dimming cycle starts, and thus the current flowing through the LED string 403 starts to increase. The detector 320 detects a startup phase of a burst dimming cycle by comparing the monitoring signal $V_{isen}$ indicative of the current flowing through the LED string 403 to the reference signal $V_{set1}$. The ON timer 442 is not triggered until the detector 320 detects that the startup phase of the burst dimming cycle ends, e.g., when the comparator 426 detects that the a difference $V_{isen}$ and $V_{set1}$ exceeds a threshold and provides the triggering signal 302 to the ON timer 442. The ON timer 442 starts to count in response to the triggering signal 302 and thus the ON period of the burst dimming cycle starts. The ON timer 442 outputs an enabling signal, e.g., logic low, to the input terminal C of the flip-flop 446 for a predetermined ON period. During the ON period, the signal at the output terminal QN of the flip-flop 446 remains at logic high. Since the dimming cycle control signal 480 is in the first state, e.g., logic high, the NAND gate 448 generates a logic low, thereby turning off the switch 449. Therefore, the burst dimming signal 490 is logic high and the pulse generator 360 is enabled during the predetermined ON period and outputs the control signal 306 including a plurality of pulses to control dimming of the LED string 403.

When the predetermined ON period ends, the ON timer 442 generates a rising edge to the input terminal C of the flip-flop 446, in one embodiment. In response to the rising edge, the signal at the output terminal QN turns to logic low. Thus, the NAND gate 448 generates a logic high, thereby turning on the switch 449. Therefore, the burst dimming signal 490 is logic low and the OFF period starts. Accordingly, the pulse generator 360 is disabled. The current through the LED string 403 may drop to zero during the OFF period. When the dimming cycle control signal 480 is switched from the first state to the second state, the burst dimming cycle ends. A new burst dimming cycle begins when the dimming cycle control signal 480 is switched from the second state to the first state again. Based on the dimming cycle control signal 480, the burst dimming signal generator 340 generates the burst dimming signal 490, e.g., a pulse-width modulation signal, to enable and disable the pulse generator 360.

In one embodiment, the controller 400 further includes an error amplifier 470. The error amplifier 470 compares the monitoring signal $V_{isen}$ indicative of the current through the LED string 403 to a reference signal $V_{set2}$ to determine if the average current flowing through the LED string 403 reaches a predetermined average current. FIG. 5(*b*) shows examples for the waveforms of the monitoring signal $V_{isen}$ and the duty cycle of the pulse signal generated by the pulse generator 360. If the average current is less than the predetermined average current, the error amplifier 470 controls the pulse generator 360 to increase the duty cycle of the pulse signal accordingly. If the current is greater than the predetermined average current, the error amplifier 470 controls the pulse generator 360 to decrease the duty cycle of the pulse signal.

Figure 6:
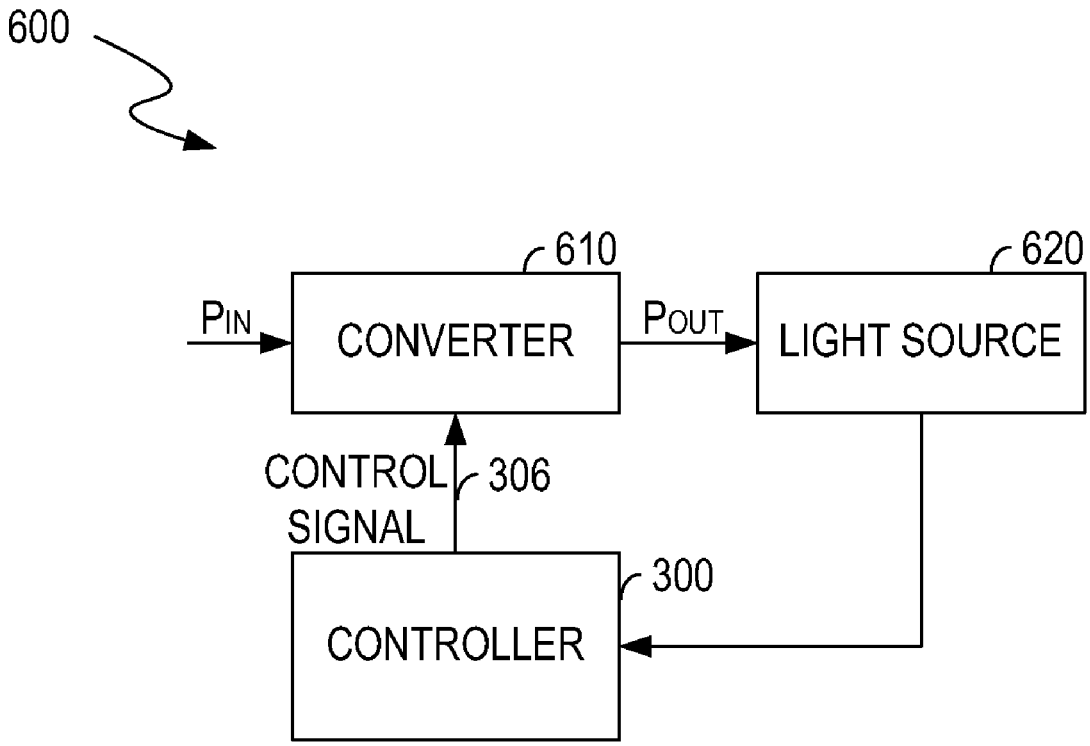
FIG. 6 is a block diagram showing an illumination system according to one embodiment of the present invention.

FIG. 6 shows an illumination system 600 according to one embodiment of the present invention. In the example of FIG. 6, the illumination system 600 includes a converter 610, a light source 620, and the controller 300. The light source 620 can include, but is not limited to, an LED. Elements labeled the same as in FIG. 3 have similar functions. The converter 610 coupled to the light source 620 converts input power $P_{IN}$ to output power $P_{OUT}$ to power the light source 620 according to the control signal 306 generated by the controller 300. By adjusting the control signal 306, the output power $P_{OUT}$ can be controlled so as to adjust the current flowing through the light source 620. Thus, brightness of the light source 620 is controlled.

Figure 1:
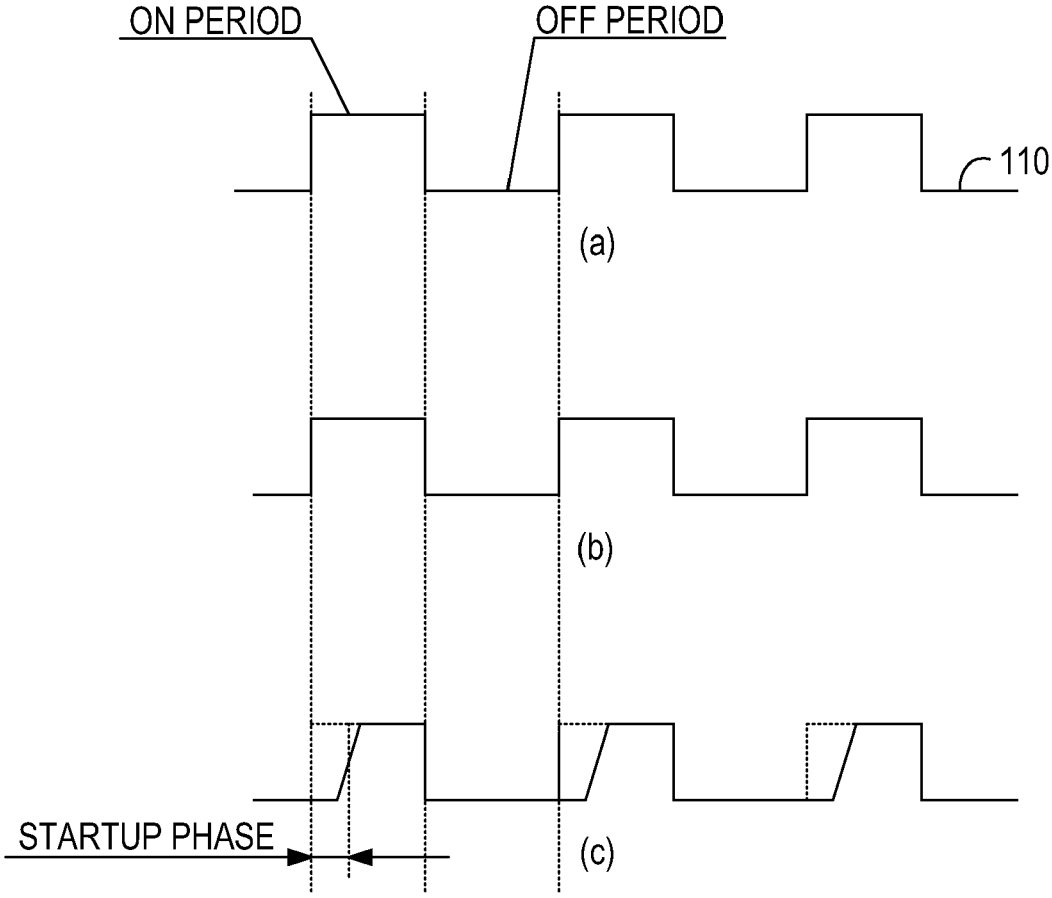
FIG. 1 PRIOR ART
FIG. 1(*a*) is a diagram showing the waveform of a burst dimming signal for controlling the brightness of a light source in the prior art.
Figure 2:
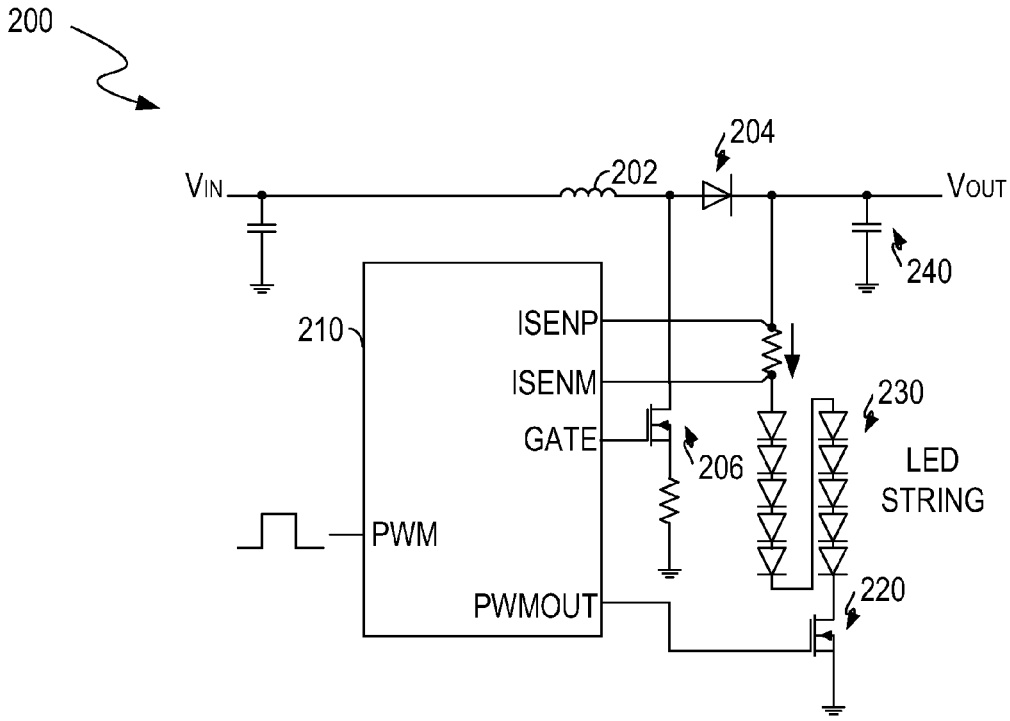
FIG. 2 PRIOR ART
FIG. 2 shows a burst dimming driving circuit in the prior art.
Figure 7:
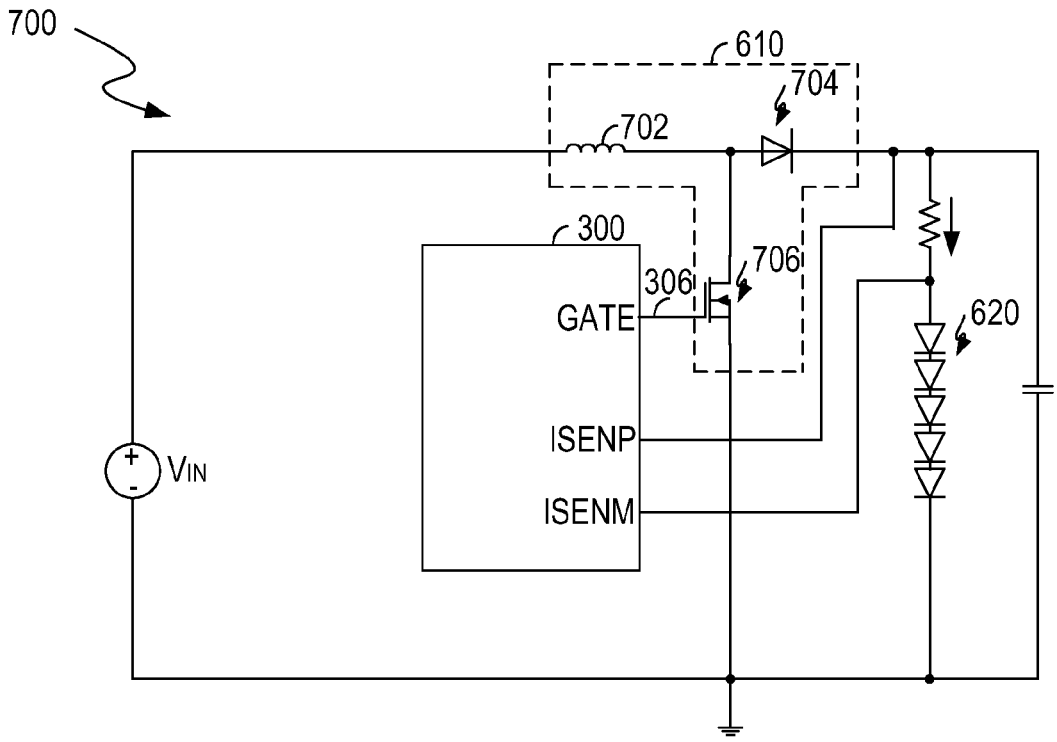
FIG. 7 is a schematic diagram showing an illumination system according to one embodiment of the present invention.

FIG. 7 shows the illumination system 700 according to one embodiment of the present invention. Elements labeled the same as in FIG. 6 have similar functions. In the example of FIG. 7, the controller 300 is implemented in an integrated circuit (IC). Advantageously, compared to FIG. 2, additional pins such as the pin PWM and the PWMOUT and the switch 320 are removed, thereby reducing the cost. The converter 610 includes a switch 706, an inductor 702, and a diode 704. Pins ISENP and ISENM are used to sense a voltage drop across a sense resistor serially coupled to the light source 620 for sensing the current flowing through the light source 620. The controller 300 is operable for generating the control signal 306 at pin GATE according to the sensed current. The switch 706 of the converter 610 is controlled by the control signal 306 so as to control the dimming of the light source 620. The switch 706 is turned on and off alternately during a predetermined ON period of a burst dimming cycle and remains off during an OFF period of the burst dimming cycle. In one embodiment, the switch 706 can also be integrated in the IC chip with the controller 300.

Figure 8:
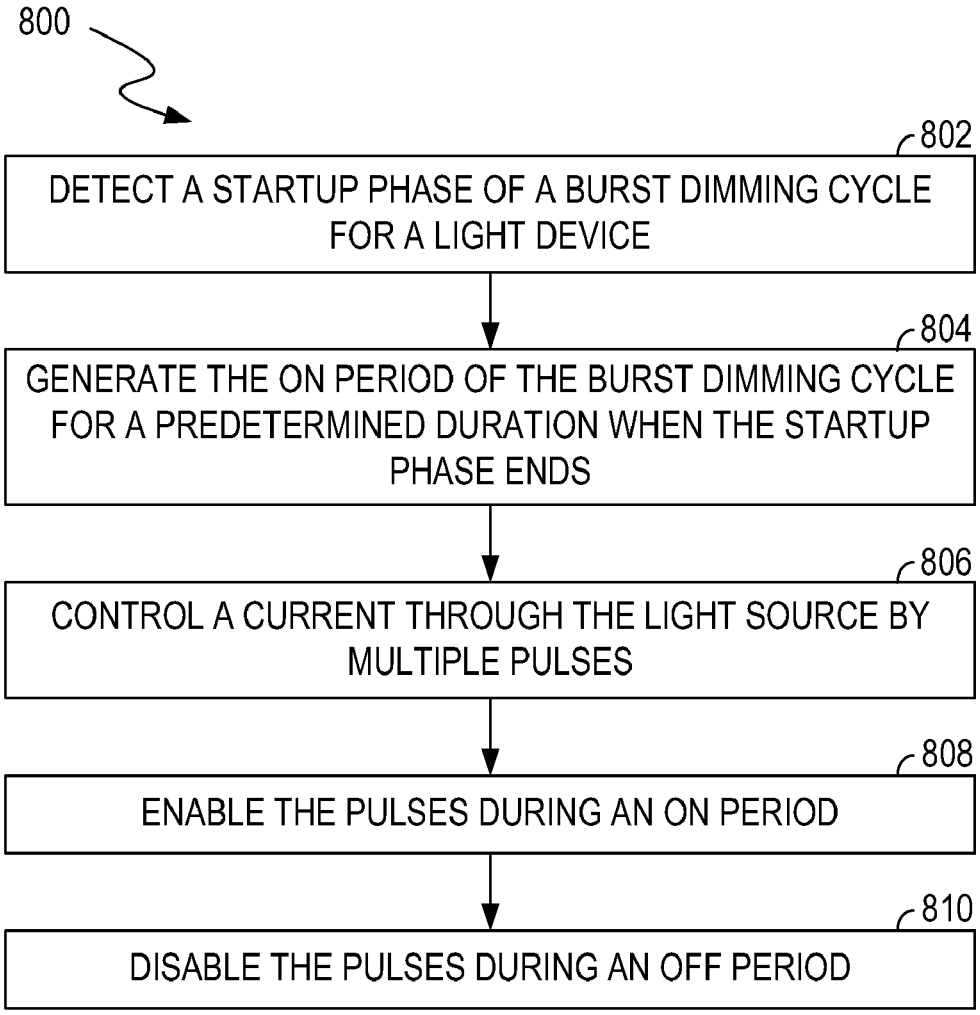
FIG. 8 is a flowchart of a method for controlling dimming of a light source according to one embodiment of the present invention.

FIG. 8 shows a flowchart 800 of a method for controlling dimming of a light source according to one embodiment of the present invention. FIG. 8 is described in combination with FIG. 3 and FIG. 4. Although specific steps are disclosed in FIG. 8, such steps are examples. That is, the present invention is well suited to performing various other steps or variations of the steps recited in FIG. 8.

In block 802, the detector 320 detects the startup phase of a burst dimming cycle of the LED string 403. The comparator 426 in the detector 320 compares the monitoring signal $V_{isen}$ indicative of the current flowing through the LED string 403 to a predetermined value, in one embodiment. In block 804, the detector 320 generates the triggering signal 302 to the ON timer 442 when the startup phases ends to trigger the ON period of the burst dimming cycle for a predetermined duration. In block 806, multiple pulses are generated by the pulse generator 360 to control a current through the LED string 403.

In block 808, the pulses are enabled during the ON period of the burst dimming cycle. As described in the example of FIG. 5, during the ON period, the signal at the output terminal QN of the flip-flop 446 stays at logic high and the dimming cycle control signal 480 from the dimming cycle timer 444 is logic high. Thus, the output signal of the NAND gate 448 is logic low, thereby turning off the switch 449. Therefore, the pulse generator 360 is enabled during the ON period and thus outputs the pulses to control the current through the LED string 403.

In block 810, the pulses are disabled during the OFF period of the burst dimming cycle. As described in the example of FIG. 5, during the OFF period, the signal at the output terminal QN of the flip-flop 446 is logic low and the dimming cycle control signal 480 is logic high. Thus, the output signal of the NAND gate 448 is logic high, thereby turning on the switch 449. Therefore, the pulse generator 360 is disabled during the OFF period.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A controller for controlling dimming of a light emitting diode (LED) light source comprising:

a detector operable for detecting a startup phase of a burst dimming cycle of said LED light source and for generating a triggering signal when said startup phase ends, wherein said burst dimming cycle comprises an ON period and an OFF period;

a dimming signal generator coupled to said detector and operable for triggering said ON period of said burst dimming cycle for a predetermined duration in response to said triggering signal; and a pulse generator coupled to said dimming signal generator and operable for generating a pulse signal to control a current through said LED light source, wherein said pulse generator is enabled during said ON period and is disabled during said OFF period.

2. The controller of claim 1, wherein said startup phase comprises a duration when said current flowing through said LED light source increases from an initial value to a predetermined value.

3. The controller of claim 1, wherein said detector comprises a comparator operable for comparing a monitoring signal indicative of said current to a reference signal and generating said triggering signal when a difference between said monitoring signal and said reference signal exceeds a threshold.

4. The controller of claim 1, wherein said dimming signal generator generates a burst dimming signal having a first state and a second state, and wherein said pulse generator is enabled during said first state and disabled during said second state.

5. The controller of claim 1, wherein said dimming signal generator comprises:

a first timer coupled to said detector and operable for generating an enabling signal for said predetermined duration; and a flip-flop operable for receiving said enabling signal and for outputting a first signal.

6. The controller of claim 5, wherein said dimming signal generator further comprises:

a second timer coupled to said first timer and operable for generating a dimming cycle control signal having a first state and a second state to control said burst dimming cycle, wherein said second state resets said first timer; and an NAND gate operable for receiving outputs from said flip-flop and said second timer and operable for outputting a second signal to control said pulse generator.

7. A method for controlling dimming of a light emitting diode (LED) light source, comprising:

detecting a startup phase of a burst dimming cycle of said LED light source, wherein said burst dimming cycle comprises an ON period and an OFF period;

triggering said ON period for a predetermined duration when said startup phase ends;

controlling a current through said LED light source by a plurality of pulses;

enabling said pulses during said ON period; and disabling said pulses during said OFF period.

8. The method of claim 7, further comprising:

adjusting a duty cycle of said pulses according to said current.

9. The method of claim 7, wherein said detecting comprises:

comparing a monitoring signal indicative of said current through said LED light source to a reference signal.

10. The method of claim 9, further comprising:

generating a triggering signal when a difference between said monitoring signal and said reference signal exceeds a threshold; and triggering said ON period in response to said triggering signal.

* * * * *